US008664856B2

(12) United States Patent
Hoene et al.

(10) Patent No.: US 8,664,856 B2
(45) Date of Patent: Mar. 4, 2014

(54) ELECTRODE FOR A DISCHARGE LAMP AND A DISCHARGE LAMP AND METHOD FOR PRODUCING AN ELECTRODE

(75) Inventors: Stefan Hoene, Wipperfuerth (DE); Manfred Kaemmer, Kierspe (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 13/122,171

(22) PCT Filed: Sep. 29, 2009

(86) PCT No.: PCT/EP2009/062576
§ 371 (c)(1),
(2), (4) Date: Apr. 1, 2011

(87) PCT Pub. No.: WO2010/043490
PCT Pub. Date: Apr. 22, 2010

(65) Prior Publication Data

US 2011/0175525 A1 Jul. 21, 2011

(30) Foreign Application Priority Data

Oct. 15, 2008 (DE) ..... 10 2008 051 825

(51) Int. Cl.
*H01J 17/18* (2006.01)
*H01J 61/36* (2006.01)

(52) U.S. Cl.
USPC ..... 313/634; 313/491; 313/493; 313/631

(58) Field of Classification Search
USPC ..... 313/484, 491, 493, 574, 579, 631, 633, 313/636, 623, 624, 625
See application file for complete search history.

(56) References Cited

U.S. PATENT DOCUMENTS

| | | | | |
|---|---|---|---|---|
| 5,936,350 | A | 8/1999 | Yoshida et al. | |
| 2002/0185974 | A1 * | 12/2002 | Nakano et al. | 313/623 |
| 2002/0190654 | A1 * | 12/2002 | Kanzaki et al. | 313/623 |
| 2003/0155864 | A1 * | 8/2003 | Wada et al. | 313/631 |
| 2003/0168980 | A1 * | 9/2003 | Hataoka et al. | 313/623 |
| 2004/0183446 | A1 | 9/2004 | Grundmann et al. | |
| 2007/0296339 | A1 | 12/2007 | Grundmann et al. | |
| 2008/0224615 | A1 * | 9/2008 | Higashi et al. | 313/631 |

FOREIGN PATENT DOCUMENTS

| | | | |
|---|---|---|---|
| DE | 950217 | C | 10/1956 |
| DE | 102004057906 | A1 | 6/2006 |
| EP | 1465237 | A2 | 10/2004 |
| JP | 446648 | A | 2/1992 |
| JP | 8273596 | A | 10/1996 |
| JP | 10223175 | A | 8/1998 |
| JP | 2002-373622 | A | 12/2002 |
| JP | 2008-181844 | A | 8/2008 |
| WO | 2005096334 | A2 | 10/2005 |

OTHER PUBLICATIONS

English machine translation of DE 950 217C.

(Continued)

*Primary Examiner* — Anh Mai
*Assistant Examiner* — Kevin Quarterman

(57) ABSTRACT

In various embodiments, an electrode for a discharge lamp is provided. The electrode may include a metal pin that has a section around which a coil made of metal wire is wound, wherein the metal wire is flattened.

3 Claims, 6 Drawing Sheets

(56) References Cited

OTHER PUBLICATIONS

The International Search Report of PCT/EP2009/062576 dated Feb. 2, 2010.
English-language abstract of JP 8-273596 A; Oct. 18, 1996.
English-language abstract of JP 4-46648 A; Feb. 17, 1992.
English-language abstract of JP 2008-181844 A; Aug. 7, 2008.
English-language abstract of JP 2002-373622 A; Dec. 26, 2002.
English machine translation of DE 950 217C, dated Oct. 4, 1956.
International Search Report of PCT/EP2009/062576 dated Feb. 2, 2010.

* cited by examiner

ELECTRODE FOR A DISCHARGE LAMP AND A DISCHARGE LAMP AND METHOD FOR PRODUCING AN ELECTRODE

RELATED APPLICATIONS

The present application is a national stage entry according to 35 U.S.C. §371 of PCT application No.: PCT/EP2009/062576 filed on Sep. 29, 2009, which claims priority from German application No.: 10 2008 051 825.5 filed on Oct. 15, 2008.

TECHNICAL FIELD

Various embodiments relate to an electrode for a discharge lamp and to a discharge lamp having at least one electrode of such kind as well as to a production method for an electrode of such kind.

BACKGROUND

Such kind of electrode is disclosed in WO 2005/096334, for example. WO 2005/096334 describes a high-pressure discharge lamp having a discharge vessel made of quartz glass and two electrodes of the same kind for producing a gas discharge in the discharge vessel's interior space. The electrodes each consist of a metal pin having a section around which a coil has been wound. Each said section of the two electrodes projects into a sealed end of the discharge vessel and is embedded in the discharge vessel's quartz glass. The coils are fitted with securing means that prevent them from slipping along the electrodes' metal pins.

SUMMARY

Various embodiments provide a generic electrode that is easier to produce and ensures good adhesion of the coil on the electrode pin. Furthermore, various embodiments disclose a production method for such kind of electrode.

The inventive electrode has a metal pin having a section around which a coil made of metal wire has been wound, with the coil's metal wire being flattened. Flattening the coil's metal wire causes a mechanical tension to develop in the metal wire, which tension will be retained when the coil wire is wound onto the metal pin and cause the coil to be pressed against the metal pin. That pressure will produce a coil that is applied tightly against the metal pin and free from play. No other securing means or fabrication steps such as welding, for instance, will be necessary for preventing the coil from slipping on the metal pin. According to an embodiment variant in which it is arranged on a central section of the metal pin, the coil will ensure that no cracks that would cause the lamp to fail prematurely can form in the discharge-vessel material because of the electrode material's and discharge-vessel material's different coefficients of thermal expansion. In another embodiment variant in which the coil is arranged on at least one end of the metal pin, the coil will ensure the dissipation of heat from that one end or, as the case may be, from both ends of the metal pin.

The coil's metal wire is embodied preferably as being flattened along its entire length to ensure the coil's turns are all applied tightly against the electrode's metal pin and free from play. The internal diameter of the coil or, as the case may be, of its individual turns corresponds to the thickness of the metal-pin section on which the coil has been wound to enable the coil to be seated on said section free from play.

The coil's metal wire is advantageously a tungsten wire or molybdenum wire. The electrode can thereby be employed in discharge lamps subject to a very high thermal load, particularly in high-pressure discharge lamps, as tungsten and molybdenum have very high melting temperatures. According to an embodiment variant in which the coil is arranged on a central section of the metal pin, the molybdenum wire additionally offers the advantage that a coil made of molybdenum wire can function as a getter and protect the sealed-in molybdenum foils at the sealed ends of a high-pressure discharge lamp's discharge vessel from materials in the discharge vessel that have a corrosive effect.

The electrode's metal pin onto which the aforementioned coil has been wound is preferably a tungsten pin to enable the electrode to be employed in discharge lamps subject to a very high thermal load, particularly in high-pressure discharge lamps.

The thickness of the coil's metal wire is preferably in the range of 10 to 1,000 micrometers.

The thickness of the electrode's metal pin is preferably in the range of 0.10 to 2.00 millimeters. Metal-pin thicknesses of such kind are coordinated with the current-carrying capacity of electrodes for high-pressure discharge lamps.

The coil's slope factor S calculated from the distance L between two adjacent turns of the coil and the coil wire's thickness D as $S=(L+D)/D$ and the coil's core factor K calculated from the core diameter D1 and the coil wire's thickness D as $K=D1/D$ are advantageously in the 1.0-to-10.0 value range. The term "core diameter" refers to the diameter of the pin onto which the coil wire is wound.

A comparatively large slope factor is advantageous in the exemplary embodiments of the invention that are shown in FIGS. 1 to 4 because the turns in the coil will be far apart owing to the relatively large slope factor so that the softened discharge-vessel material will be able to penetrate between adjacent turns in the coil when the discharge lamp's discharge vessel is being sealed and wet the surface of the electrode. Said coil will owing to its large slope factor also have a low thermal capacity so that the discharge-vessel material will cool more slowly when flowing around the coil and a good seal be achieved thereby. The first and last turn located on the ends of the coil can for production reasons have a smaller slope factor.

In the exemplary embodiments of the invention that are shown in FIGS. 5 to 8, the coil's slope factor and core factor are embodied such as to ensure good dissipation of heat from the electrode's discharge-side end.

The electrode according to the exemplary embodiments shown in FIGS. 1 to 4 is especially well-suited for use in discharge lamps having a discharge vessel made of quartz glass. They are in particular high-pressure discharge lamps and preferably halogen metal-vapor high-pressure discharge lamps with a mercury-free filling. Owing to their high warm-up current the latter require comparatively thick electrodes having a high current-carrying capacity and also needing to be made of a metal such as tungsten, for instance, that is resistant to high temperatures. Owing to the very different coefficients of thermal expansion of tungsten and quartz glass and the comparatively thick electrodes, the above-described problem of premature lamp failure due to the formation of cracks in the discharge vessel is therefore particularly acute in the case of halogen metal-vapor high-pressure discharge lamps with a mercury-free filling. The section of the inventive electrodes' metal pin around which the coil has been wound is embedded in the discharge-vessel material of a sealed end of the discharge vessel in order to establish an electric contact with an external power feed via a sealed-in molybdenum foil at the sealed end. Premature lamp failure due to the formation of cracks in the discharge vessel will be avoided also in the case of the last-cited type of lamp with the aid of the coil on the inventive electrode.

The electrodes according to the exemplary embodiments of the invention that are shown in FIGS. 5 to 8 can be employed in different types of high-pressure discharge lamps. The use of said electrodes is in particular not limited to high-pressure discharge lamps having a discharge vessel made of quartz glass; said electrodes can be used also in high-pressure discharge lamps having a discharge vessel made of a translucent ceramic material. A relevant instance is shown schematically in FIG. 5.

The inventive production method for the above-described electrode of a discharge lamp is distinguished in that a flattened metal wire is wound around the electrode's metal pin or, as the case may be, a section of its metal pin during a step of the inventive production method in order to form a coil that is arranged tightly and free from play on the electrode's metal pin or, as the case may be, a section of its metal pin. Inventively flattening the coil wire causes a mechanical tension to develop in the coil's metal wire, which tension will be retained when it is wound onto the electrode's metal pin and cause the turns in the coil to be pressed against the metal pin. As a result, no further securing means will be necessary for fixing the coil into place on the electrode's metal pin. What in particular are unnecessary are fabrication steps such as, for example, welding the coil on the metal pin or pressing the metal pin into the coil. The inventive production method thus also obviates local damage to the electrode as well as altering of the coil's structure owing to its being welded. The fabrication method for the electrode is altogether simplified by the invention.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 4:
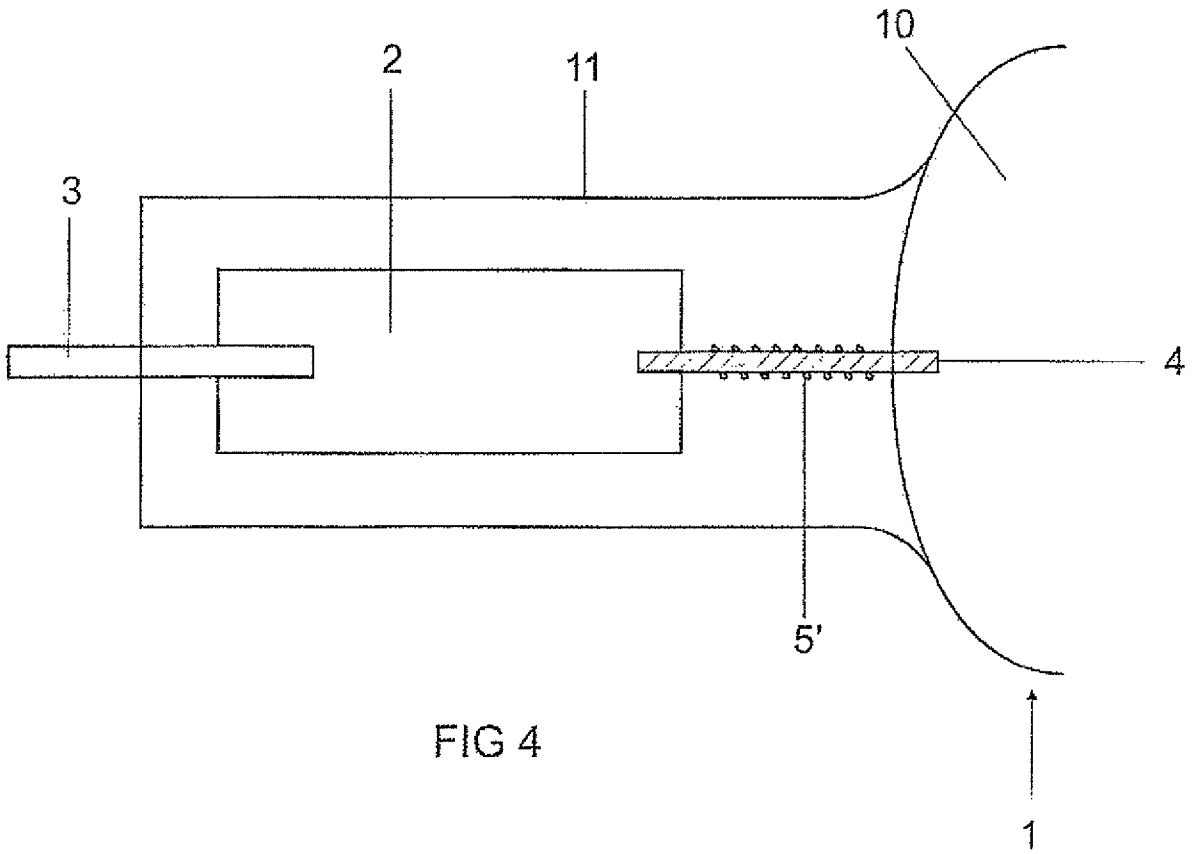
FIG. 4 shows a sealed end of a discharge vessel, made of quartz glass, of a high-pressure discharge lamp having the electrode shown in FIG. 3

FIG. 4 shows an end 11, closed by means of a molybdenum foil seal, of a discharge vessel 1, sealed on two sides and made of quartz glass, of a high-pressure discharge lamp for a vehicle headlight having an electrode according to the second exemplary embodiment of the invention, including the power feed ducted through the closed end 11 of the discharge vessel 1. The lamp is in particular a halogen metal-vapor high-pressure discharge lamp that is free of mercury and has an electric power consumption of 35 watts. Located in the interior space 10 of the discharge vessel 1 is an ionizable filling consisting of xenon and the halides of the metals sodium, scandium, zinc, and indium. The discharge vessel's volume is 24 $mm^3$.

Figure 1:
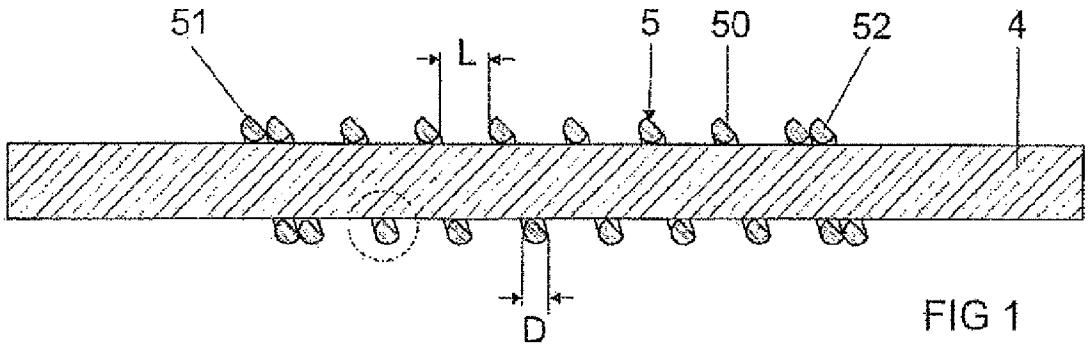
FIG. 1 shows an electrode according to the first exemplary embodiment of the invention

The power feed has a molybdenum foil 2 embedded in the closed end 11 of the discharge vessel 1 in a gas-tight manner. The molybdenum foil 2 is 6.5 mm long, 2 mm wide, and 25 μm thick. The end—facing away from the interior space 10 of the discharge vessel 1—of the molybdenum foil 2 is welded to the molybdenum wire 3 that projects from the sealed end 11 of the discharge vessel 1. The end—facing the interior space 10 of the discharge vessel 1—of the molybdenum foil 2 is welded to a tungsten pin 4 that forms one of the high-pressure discharge lamp's two electrodes and projects into the discharge chamber 10. The tungsten pin 4 is 7.5 mm long and its thickness or, as the case may be, diameter D1=0.30 mm. The overlap between the tungsten pin 4 and the molybdenum foil 2 is 1.30 mm±0.15 mm. A coil 5' is arranged centrally on the tungsten pin 4 so that it is 2.25 mm from either end of the tungsten pin 4. The coil 5' is 3 mm long. It consists of a flattened tungsten wire 50 whose maximum gauge or, as the case may be, maximum thickness D=60 μm. The coil wire 50 is less thick in the direction perpendicular to the flattening 500. The internal diameter of the coil 5' corresponds to the diameter or, as the case may be, thickness of the tungsten pin 4. The distance between two adjacent turns in the coil 5' is 340 μm. The slope factor S of the coil 5' is hence 6.67. The core factor K of the coil 5' is calculated from the core diameter, corresponding here to the diameter D1 of the tungsten pin 4, and the maximum thickness D of the coil wire as K=5. According to the second exemplary embodiment of the invention, as shown schematically in FIG. 4, the coil 5' extends only across the section of the tungsten pin 4 or, as the case may be, of the electrode that is located in the closed end 11 of the discharge vessel 1 and does not overlap the molybdenum foil 2. The distance between the coil 5' and the molybdenum foil 2 is 0.95 mm. The coil 5' can, though, also project into the discharge chamber 10. Its action will not be impaired thereby. The other closed end (not shown) of the discharge vessel 1 is embodied as identical to the end 11. In particular it likewise has an electrode as shown in FIG. 1 or, as the case may be, 3. The distance between the ends, projecting into the interior space 10 of the discharge vessel 1, of the two tungsten pins 4 or, as the case may be, electrodes is 4.2 mm. The two electrodes are arranged mutually opposite in the longitudinal axis of the discharge vessel 1.

Figure 2:
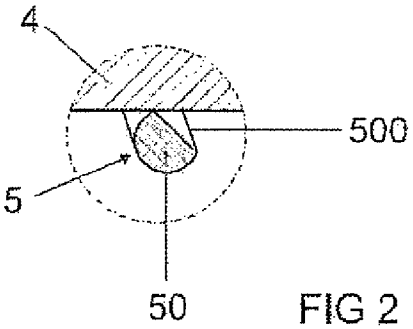
FIG. 2 is an enlarged representation of a section of the electrode shown in FIG. 1

The electrode according to the first exemplary embodiment is shown enlarged in FIG. 1. The electrode consists of a tungsten pin 4 and a coil 5 that has been wound onto the tungsten pin 4. As has already been explained above, the coil extends only across a centrally located section of the tungsten pin 4. The coil 5 consists of a flattened tungsten wire 50. FIG. 2 is an enlarged detailed view of a turn in the coil 5 with the flattening 500 of the coil wire 50 shown schematically. Apart from the first turn 51 and the last turn 52 in the coil 5, the distance L between two adjacent turns is 340 μm. A coil's slope factor S is calculated from the distance L and coil-wire diameter D as S=(L+D)/D. So the slope factor of coil 5, apart from its first and last turn, is 6.67 or, as the case may be, 667 percent and its core factor K is 5.

To produce the inventive electrode, a tungsten wire 50 that has been flattened at least along a part of its length is wound around a tungsten pin 4 produced according to customary powder-metallurgy fabrication steps and wire-drawing methods.

The aforementioned customary powder-metallurgy fabrication steps and wire-drawing methods can likewise be used for producing the tungsten wire 50. A winding method customarily employed for producing singly coiled incandescent filaments is used for winding the tungsten wire 50 onto the tungsten pin 4.

Figure 3:
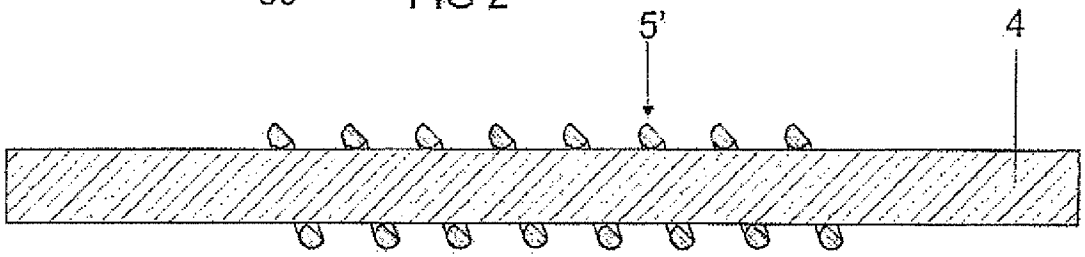
FIG. 3 shows an electrode according to the second exemplary embodiment of the invention

The electrode according to the second exemplary embodiment of the invention is shown schematically in FIG. 3. That exemplary embodiment differs from the first, preferred exemplary embodiment only with respect to the coil 5'. In the case of the coil 5', the first and last turn are also located 340 μm from their respectively adjacent turn so that the coil 5' has a slope factor end-to-end of 6.67 or, as the case may be, 667 percent. The coils 5 and 5' and hence also the electrodes are in all other respects identical.

The high-pressure discharge lamp according to the exemplary embodiment shown in FIG. 4 furthermore has an outer bulb, which encloses the discharge vessel 1 in the region of the discharge chamber 10, and a lamp base. Those details are described and illustrated in, for example, EP 1 465 237 A2.

Figure 5:
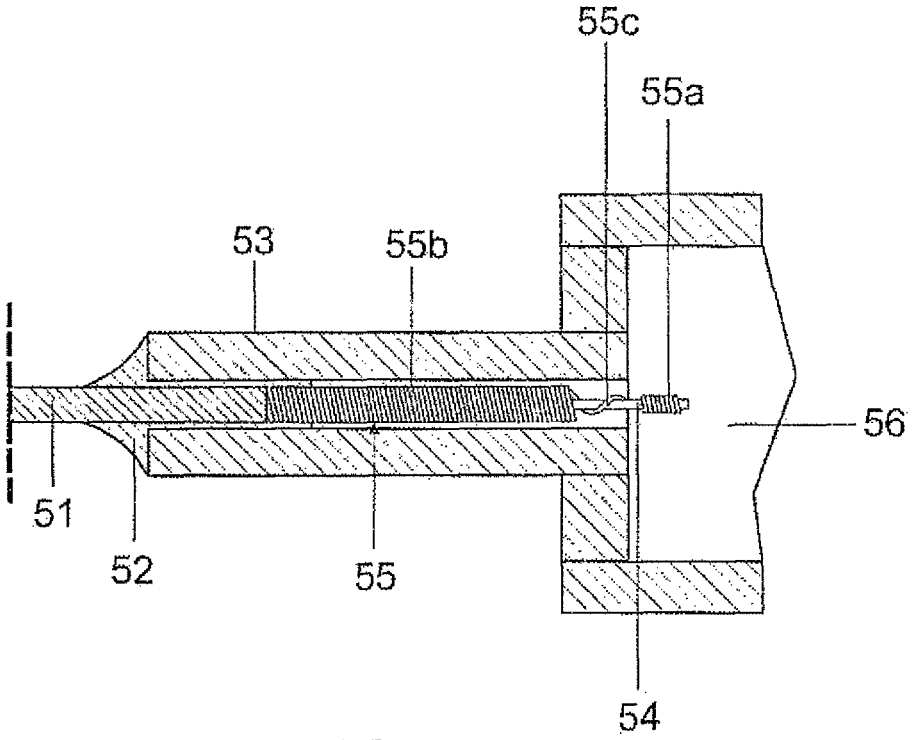
FIG. 5 shows a sealed end of a discharge vessel, made of a ceramic material, of a high-pressure discharge lamp having an electrode according to the third exemplary embodiment of the invention

Shown in FIG. 5 is a sealed end of a discharge vessel, made of a translucent aluminum oxide ceramic, of a high-pressure discharge lamp having an electrode according to the third exemplary embodiment of the invention. The electrode's end piece 51 has been sealed in the ceramic capillary 53 by means of the glass solder 52. The adjoining end piece 51 is the metal pin 54 around which the coil 55 made of tungsten wire has been wound. The coil 55 includes a first winding 55*a* which is located on the discharge-side end of the metal pin 54 and has approximately 6 turns. The coil 55 additionally includes a second winding 55*b* which surrounds the section of the metal pin 54 that extends inside the ceramic capillary 53 and has approximately 30 turns. The end adjoining the end piece 51 of the metal pin 54 and the corresponding end of the second winding 55*b* are likewise embedded in the glass solder 52. The windings 55*a*, 55*b* of the coil 55 are mutually joined by the coil wire 55*c*. The coil wire 55*c* is embodied as flattened at least in the region of the first winding 55*a* or the second winding 55*b* to ensure that the coil 55 is seated on the metal pin 54 free from play. The coil wire 55*c* is preferably embodied as flattened in the region of both windings 55*a*, 55*b*. The thicker section, located in the ceramic capillary 53, of the metal pin 54 that is surrounded by the second winding 55*b* is made of molybdenum. The thinner section, projecting into the discharge vessel's discharge chamber 56, of the metal pin 54 that is surrounded by the first winding 55*a* is made of tungsten. The diameter or, as the case may be, thickness of the coil wire 55*c* is in the range of 0.15 to 0.19 mm. The core factor of the coil 55 or, as the case may be, its windings 55*a*, 55*b* is in the range of 0.2 to 0.5.

Figure 6:
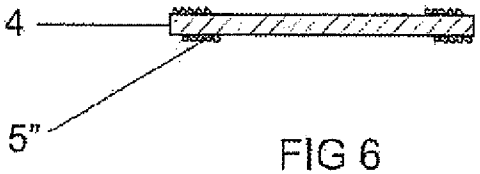
FIG. 6 shows an electrode according to the fourth exemplary embodiment of the invention

FIG. 6 shows an electrode according to the fourth exemplary embodiment of the invention. Said electrode consists of a tungsten pin 4 and two coils 5" wound around both ends of the tungsten pin 4. The coils 5" each consist of a flattened tungsten wire wound around the corresponding end of the tungsten pin 4. Said electrode can be used in place of, for example, the metal pin 54 shown in FIG. 5 and the coil 55 in a ceramic discharge vessel in a high-pressure discharge lamp.

Figure 7:
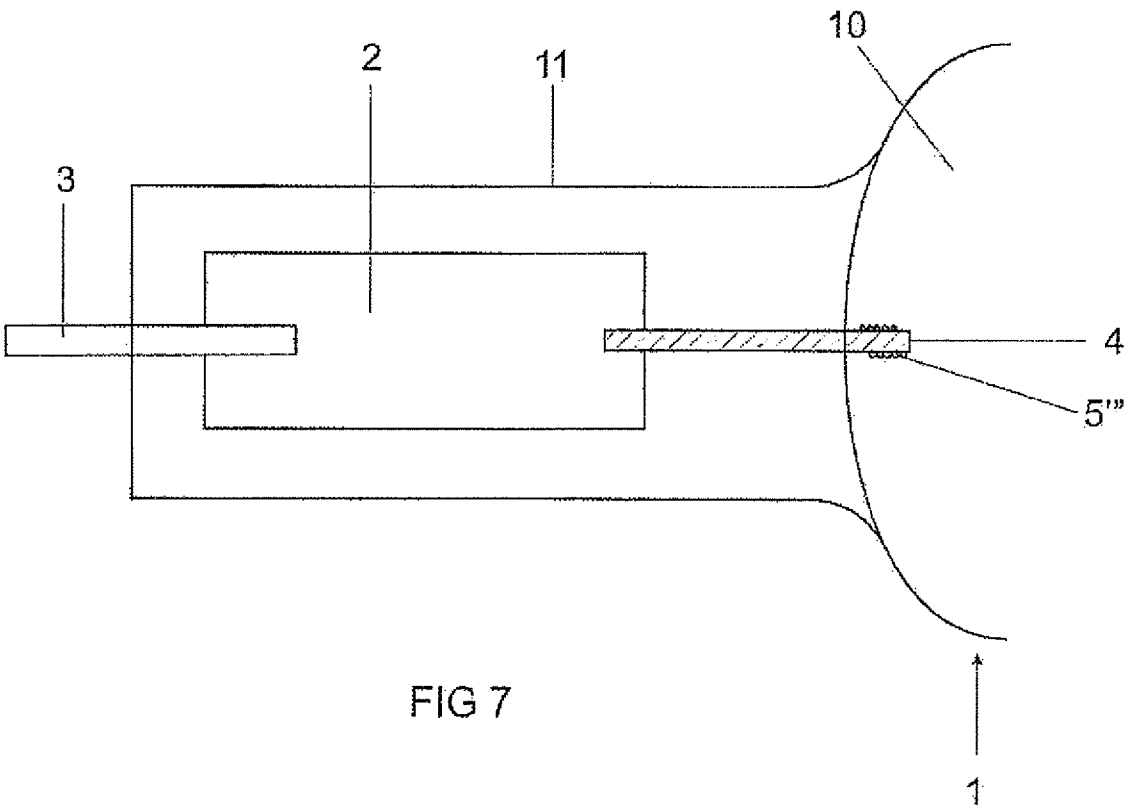
FIG. 7 shows a sealed end of a discharge vessel, made of quartz glass, of a high-pressure discharge lamp having an electrode according to the fifth exemplary embodiment of the invention

Shown in FIG. 7 is a sealed end 11 of a discharge vessel 1, made of quartz glass, of a high-pressure discharge lamp having an electrode according to the fifth exemplary embodiment of the invention. Sealed in the discharge vessel's sealed end 11 in a gas-tight manner is a molybdenum foil 2. The end, facing away from the discharge chamber 10 of the discharge vessel 1, of the molybdenum foil 2 is joined to a power feed 3 made of molybdenum. The end facing the discharge chamber 10 of the molybdenum foil 2 is joined to a tungsten pin 4 that has an end projecting into the discharge chamber 10. Wound around the end, projecting into the discharge chamber 10, of the tungsten pin 4 is a coil 5''' made of tungsten wire. The tungsten wire of coil 5''' is embodied as flattened wire. The flattened coil wire has a thickness in the range of 0.17 to 0.40 mm and the core factor of the coil 5''' is in the range of 0.3 to 0.6. The individual turns of the coil 5''' have been wound onto the discharge-side end of the tungsten pin 4 at a close distance to each other so the slope factor of coil 5''' is close to 1. The tungsten pin 4 and the coil 5''' form a gas-discharge electrode for the high-pressure discharge lamp. The coil 5''' serves to dissipate heat from the gas-discharge electrode's discharge-side end.

Figure 8:
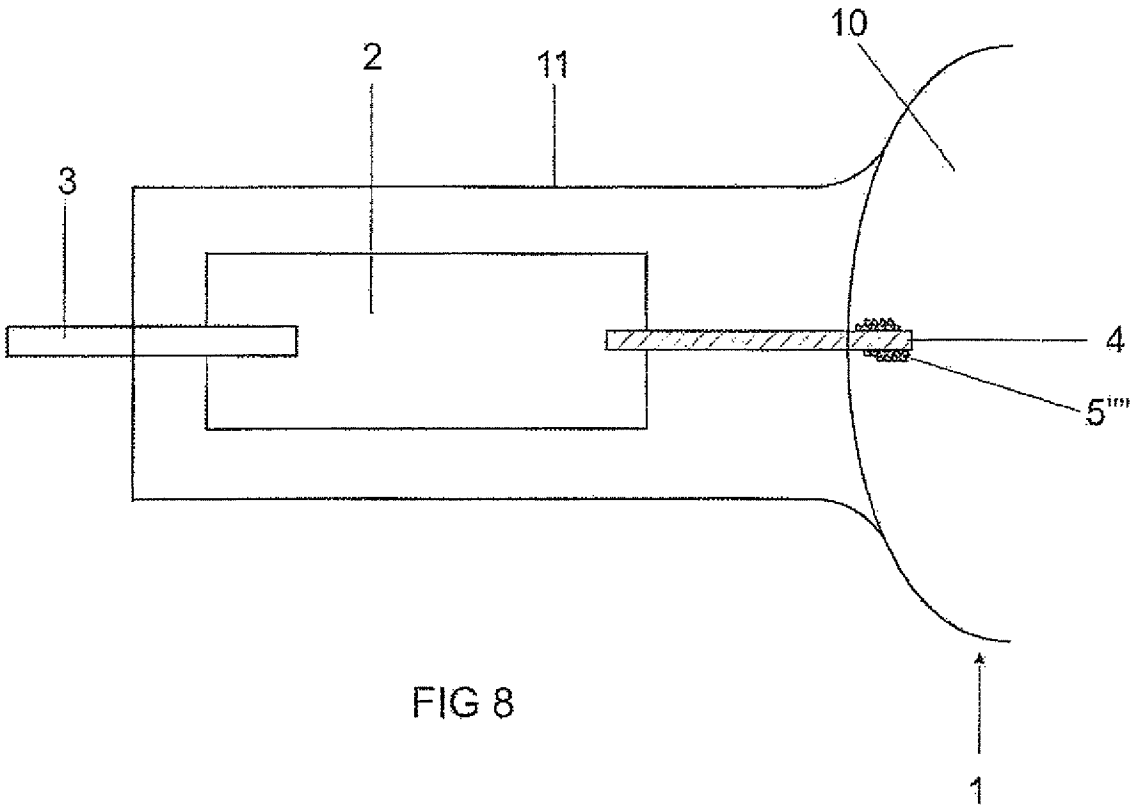
FIG. 8 shows a sealed end of a discharge vessel, made of quartz glass, of a high-pressure discharge lamp having an electrode according to the sixth exemplary embodiment of the invention

Shown in FIG. 8 is a sealed end 11 of a discharge vessel, made of quartz glass, of a high-pressure discharge lamp having an electrode according to the sixth exemplary embodiment of the invention. Sealed in the sealed end 11 of discharge vessel 1 in a gas-tight manner is a molybdenum foil 2. The end, facing away from the discharge vessel's discharge chamber 10, of the molybdenum foil 2 is joined to a power feed 3 made of molybdenum. The end, facing the discharge chamber 10, of the molybdenum foil 2 is joined to a tungsten pin 4 that has an end projecting into the discharge chamber 10. Wound around the end, projecting into the discharge chamber 10, of the tungsten pin 4 is a coil 5'''' made of tungsten wire. The tungsten wire of the coil 5'''' is embodied as flattened wire. The flattened coil wire has a thickness in the range of 0.3 to 0.6 mm and the core factor of the coil 5'''' is in the range of 0.35 to 0.8. The individual turns of the coil 5'''' have been wound onto the end, projecting into the discharge chamber 10, of the tungsten pin 4 in two layers at a close distance to each other so the slope factor of the coil 5'''' is close to 1. The tungsten pin 4 and the coil 5'''' form a gas-discharge electrode for the high-pressure discharge lamp. The coil 5'''' serves to dissipate heat from the gas-discharge electrode's discharge-side end.

Figure 9:
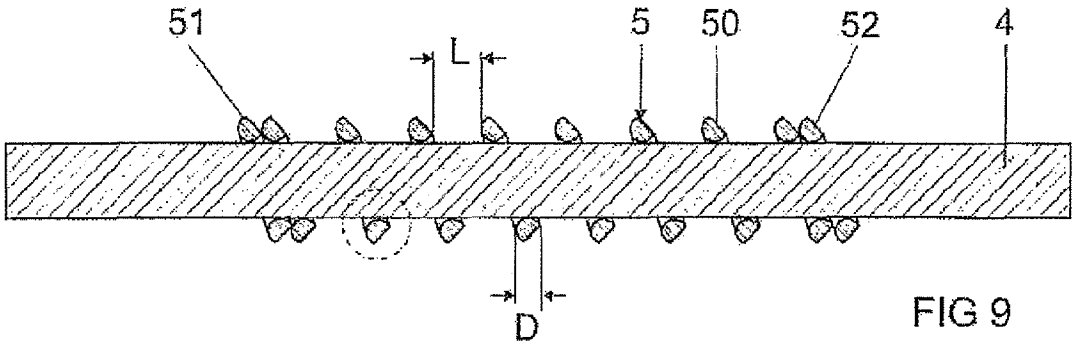
FIG. 9 shows an electrode according to the seventh exemplary embodiment of the invention
Figure 10:
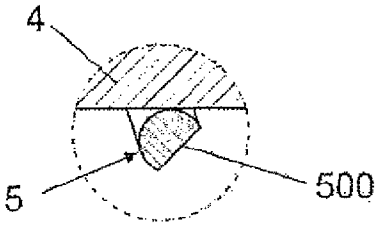
FIG. 10 is an enlarged representation of a section of the electrode shown in FIG. 9

Shown schematically and enlarged in FIGS. 9 and 10 is an electrode according to the seventh exemplary embodiment of the invention. Said electrode differs from the electrode shown in FIGS. 1 and 2 according to the first exemplary embodiment only with respect to the orientation of the flattening 500 of the coil wire 50 after being wound onto the tungsten pin 4. The same reference numerals as in FIGS. 1 and 2 have therefore been used for the mutually corresponding electrode parts in FIGS. 9 and 10. The flattening 500 of the coil wire 50 is oriented according to the seventh exemplary embodiment of the invention such that it points away from the tungsten pin 4.

Figure 11:
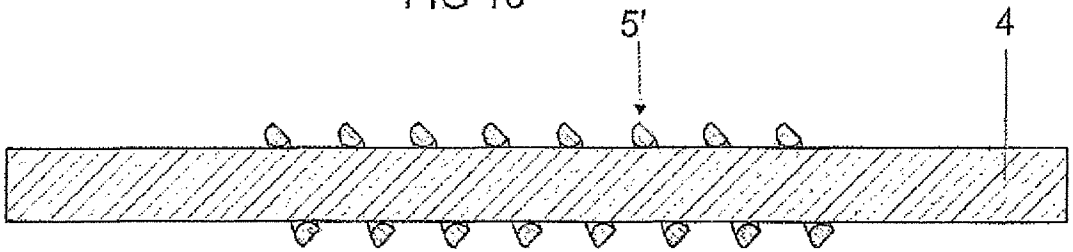
FIG. 11 shows an electrode according to the eighth exemplary embodiment of the invention

Shown schematically and enlarged in FIG. 11 is an electrode according to the eighth exemplary embodiment of the invention. Said electrode differs from the electrode shown in FIG. 3 according to the second exemplary embodiment only with respect to the orientation of the flattening of the coil wire after being wound onto the tungsten pin 4. The same reference numerals as in FIG. 3 have therefore been used for the mutually corresponding electrode parts in FIG. 11. Flattening of the coil wire is oriented according to the eighth exemplary embodiment of the invention such that it points away from the tungsten pin 4 and faces away from the tungsten pin 4.

The invention is not limited to the exemplary embodiments explained above in more detail. For example the coil 5 or, as the case may be, 5' according to the first, second, seventh, or eighth exemplary embodiment can be fabricated also from a flattened molybdenum instead of a flattened tungsten wire 50 wire in order to achieve the above-described getter effect. It is furthermore also possible for the turns of the coil 5 or, as the case may be, 5' to be arranged closer to each other or further apart than has been described for the above-cited exemplary embodiments.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A discharge lamp comprising:

at least one electrode, wherein the electrode comprises a metal pin that has a section around which a coil made of metal wire is wound, and wherein the metal wire is flattened;

a discharge vessel made of quartz glass, wherein the at least one electrode projects into a sealed end of the discharge vessel and the section, around which the coil is wound, of the at least one electrode's metal pin is embedded at least along a part of its length in the quartz glass of the sealed end of the discharge vessel.

2. The discharge lamp as claimed in claim 1 being embodied as a high-pressure discharge lamp with a mercury-free filling.

3. The discharge lamp as claimed in claim 1, wherein the coil is located on a discharge-side end of the at least one electrode.

* * * * *